US008267579B2

(12) United States Patent
Kruse et al.

(10) Patent No.: US 8,267,579 B2
(45) Date of Patent: Sep. 18, 2012

(54) FILM PACKAGING BAG

(75) Inventors: Alfons Kruse, Dinklage (DE); Jochen Brauer, Lohne (DE)

(73) Assignee: Nordenia Deutschland Halle GmbH, Halle (DE)

( * ) Notice: Subject to any disclaimer, the term of this patent is extended or adjusted under 35 U.S.C. 154(b) by 1304 days.

(21) Appl. No.: 11/903,056

(22) Filed: Sep. 20, 2007

(65) Prior Publication Data

US 2008/0080794 A1 Apr. 3, 2008

(30) Foreign Application Priority Data

Oct. 2, 2006 (EP) ..... 06020699

(51) Int. Cl.
*B65D 33/14* (2006.01)
*B65D 33/06* (2006.01)

(52) U.S. Cl. ..... 383/26; 383/28; 383/20; 383/21; 383/17

(58) Field of Classification Search ..... 383/6, 14, 383/17, 20, 21, 25, 26, 28; 190/115, 117; 150/107, 110
See application file for complete search history.

(56) References Cited

U.S. PATENT DOCUMENTS

| | | | | |
|---|---|---|---|---|
| 3,208,492 | A * | 9/1965 | Braithwaite | 383/8 |
| 3,801,012 | A * | 4/1974 | Thelen | 229/117.22 |
| 4,148,431 | A * | 4/1979 | Lepisto | 383/14 |
| 4,286,714 | A * | 9/1981 | Zdarsky et al. | 206/526 |
| 4,550,439 | A | 10/1985 | Peppiatt et al. | |
| 4,583,681 | A * | 4/1986 | Neese | 229/117.22 |
| 4,905,888 | A * | 3/1990 | Suoss et al. | 229/117.22 |
| 5,048,976 | A * | 9/1991 | Jung et al. | 383/10 |
| 5,186,542 | A * | 2/1993 | Seabold | 383/25 |
| 5,474,172 | A * | 12/1995 | Zavatone et al. | 206/158 |
| 6,010,004 | A * | 1/2000 | Huckriede et al. | 206/525 |
| 6,220,506 | B1 * | 4/2001 | Knight | 229/117.22 |
| 6,598,784 | B2 * | 7/2003 | LaBras et al. | 229/117.22 |
| 7,670,050 | B2 * | 3/2010 | Haimerl et al. | 383/28 |
| 7,866,885 | B2 * | 1/2011 | Kujat et al. | 383/6 |
| 2004/0032993 | A1 * | 2/2004 | Tetenborg | 383/17 |
| 2006/0188178 | A1 | 8/2006 | Haimerl et al. | |
| 2008/0080794 | A1 * | 4/2008 | Kruse et al. | 383/14 |
| 2010/0329590 | A1 * | 12/2010 | Minkler | 383/6 |

FOREIGN PATENT DOCUMENTS

| | | |
|---|---|---|
| DE | 21 55 091 | 5/1972 |
| DE | 92 00 869 | 4/1992 |
| DE | 203 11 386 | 11/2003 |
| EP | 0 553 693 | 8/1993 |
| WO | WO 92/06900 | 4/1992 |

* cited by examiner

*Primary Examiner* — Nathan J Newhouse
*Assistant Examiner* — Peter Helvey
(74) *Attorney, Agent, or Firm* — Collard & Roe, P.C.

(57) ABSTRACT

A film packaging bag has bag surfaces formed by a bag film and a carrying handle disposed on one of the bag surfaces, whereby the carrying handle has a film strip having a handle segment that is accessible via an opening in the bag film, during use. The film strip is disposed on a carrier sheet, whereby the film strip surrounds the carrier sheet with folded strip ends that follow the handle segment, which sheet is wider than the film strip. The film strip is attached to the bag film by way of the carrier sheet, whereby the carrier sheet is connected with the inside of the bag to the side of the film strip, directly or indirectly.

16 Claims, 3 Drawing Sheets

1
2
3
4
5
6
7
9
10
23
A
A

FILM PACKAGING BAG

CROSS REFERENCE TO RELATED APPLICATIONS

Applicants claim priority under 35 U.S.C. 119 of European Application No. 06 020 699.2 filed Oct. 2, 2006.

BACKGROUND OF THE INVENTION

1. Field of the Invention

The present invention relates to a film packaging bag having bag surfaces formed by a film and a carrying handle, which is disposed on a bag surface. The carrying handle has a film strip having a handle segment that is accessible via an opening in the bag film during use. Furthermore, the invention relates to a method for the production of the film packaging bag. The film packaging bag is particularly suitable for packaging bulk goods such as palletized animal feed, detergents, cat litter, road salt. The film packaging bag is also suitable for packaging construction materials in powder or granular form. The film packaging bag can easily be transported using the carrying handle.

2. The Prior Art

A film packaging bag having the characteristics described initially is known from the reference DE 203 11 386 U1. The carrying handle is formed by a film strip that is attached to the inside of the bag or the outside of the bag with its two strip ends. The carrying capacity of the known film packaging bag is in need of improvement. Great forces can occur at the connection points between the strip ends and the bag film of the film packaging bag, particularly in the case of heavy film bags, which forces can lead to tearing at the connection points.

SUMMARY OF THE INVENTION

In view of this background, it is an object of the invention to provide a film packaging bag having the characteristics described initially, in which the carrying handle guarantees improved distribution of the carrying load. In particular, the film packaging bag should also be usable for large carrying loads.

These and other objects are achieved by providing a film packaging bag according to the invention. The film packaging bag includes a carrying handle including a film strip having a handle segment. The film strip is disposed on the carrier sheet so that the film strip surrounds the carrier sheet with folded strip ends that follow the handle segment, which sheet is wider than the film strip. The film strip is attached to the bag film via the carrier sheet, whereby the carrier sheet is connected with the inside of the bag to the side of the film strip, directly or indirectly.

According to the invention, the film strip is connected with the bag film not directly but rather by way of the carrier sheet, whereby the force that acts on the carrying handle when the film packaging bag is carried is first distributed onto the carrier sheet and thereby to a large surface to the side of the film strip. It is possible to clearly increase the carrying load by means of a more uniform distribution of force, in comparison with the state of the art, while using the same film materials for the bag film and the film strip.

In a preferred embodiment, to achieve a particularly great carrying capacity of the carrying handle, the folded strip ends overlap in segments. The folded strip ends are connected in the overlap region, preferably by means of heat-sealing, so that the film strip forms a closed loop. In this connection, the strip ends can optionally also be fixed in place on the carrier sheet directly, via heat-sealing or gluing. The strip ends may also not be connected directly with one another, but connected only with the carrier sheet.

In another advantageous embodiment, the handle segment lies on a center or intermediate segment and the strip ends lie on folded end segments of the carrier sheet. Such an embodiment guarantees particularly great carrying force, on the one hand, and is easy to produce, on the other hand.

Preferably, the carrier sheet and the film strip are covered by a closure sheet on the inside of the bag, at least in certain segments. The closure sheet serves to tightly close the film packaging bag in the region of the carrying handle, whereby at least the bending points of the film strip are covered by the closure sheet or two closure sheet segments. Preferably, the closure sheet covers the film strip and the carrier sheet completely, on the inside of the bag.

According to the invention, the carrying load when carrying the film packaging bag is first transferred to the carrier sheet and then onto the film packaging bag, over a large area. In this connection, within the scope of the invention, the carrier sheet can be connected with the inside of the bag either by way of the closure sheet or preferably directly.

To permit grasping of the handle segment on the outside of the bag, the bag film can have running incisions or an opening in the form of a punched-out area in the region of the carrying handle, to the side of the handle segment. Through these incisions or openings, the handle segment becomes accessible. Furthermore, a weakening line or perforation can also be provided in the region of the carrying handle, whereby the handle segment can be released by opening the weakening line or the perforation. The weakening line or perforation is preferably closed in itself, so that the film segment delimited by the weakening line or perforation can be completely removed from the bag film that forms the bag surfaces. In this connection, the film segment can be connected with the handle segment via heat-seal seams, adhesive, or both, whereby the film segment remains on the handle segment after the weakening line or perforation has been opened, and does not have to be disposed of as a separate part. Furthermore, the film segment can also contribute to increasing the carrying capacity of the carrying handle, to a certain extent. The bag film, the film strip, the carrier sheet, and the closure sheet are preferably connected with one another by heat-sealing. Fundamentally, however, gluing or a combination of gluing and heat-sealing are also possible.

The bag film is preferably a composite film having an inner surface of a polyolefin, which can be sealed well. For example, composite films having an outer surface of polyethylene terephthalate (PET) and an inner surface of polyethylene (PE) are suitable. Without restriction, additional film layers, for example to increase the stability, the barrier effect, or both, can be disposed between the inner surface and the outer surface. Composite materials having layers of different polyethylene types can also be used. Preferably, the polymer composition of the inner surface is structured so that only the inner surface melts at a suitable sealing temperature. The film strip, the carrier sheet, and the closure sheet are also preferably structured in multiple layers. For example, composite materials of coextruded polyethylene or multi-layer laminated films of high-density polyethylene (HDPE) are suitable. A laminate in which the individual film layers of HDPE are first stretched and subsequently laminated is available under the trade name Valerone®. Such films are characterized by great tensile strength, tear resistance, and resistance to penetration. According to the invention, the entire film packaging bag can also be made from polyethylene (PE) and therefore can be easily recycled.

To achieve great carrying capacity of the film strip, the film strip can preferably be formed from at least two layers that are connected at the lengthwise edges of the film strip by sealing seams. In this embodiment of the film strip, the film strip can be formed from the same material as the carrier sheet, the closure sheet, or also the bag film, for example despite the increased demands on the carrying load. By laying together the at least two layers, a very great tear resistance can be achieved, overall, even in the case of a slight material thickness. The film packaging bag according to the invention typically has a carrying load of at least 2.5 kg, preferably of more than 10 kg. Depending on the thickness of the film material for the film packaging bag, clearly greater carrying loads can easily be reached as well. For example, carrying loads of 25 kg and 50 kg can easily be reached.

In another aspect of the invention, the carrying handle can be disposed completely freely on one of the bag surfaces. An embodiment in which the film packaging bag is structured as a side fold bag having two front surfaces is particularly advantageous, whereby the carrying handle is disposed on one of the side folds that connect the front surfaces at their edges. A uniform force distribution and convenient handling of the filled film packaging bag can be achieved via approximately centered disposition on the typically narrow side fold. In this connection, the side fold with the carrying handle is usually folded inward before the side fold bag is filled and closed, thereby facilitating machine handling and therefore also filling of the side fold bag. Furthermore, a very high-quality appearance of the film packaging bag can be made possible by the continuous, usually imprinted front surfaces.

In a preferred embodiment of the invention, the film packaging bag has a re-closure. Because the carrying handle can be positioned on a bag surface, without restriction, the disposition of the re-closure can also be freely selected in accordance with the requirements, in each instance.

A method for the production of a film packaging bag is also provided. In accordance with this aspect of the invention, a film strip is disposed on a carrier sheet that is wider than the film strip, whereby strip ends of the film strip are folded over, so that the film strip surrounds the carrier sheet with the strip ends, whereby subsequently, the carrier sheet is connected with the bag film, directly or indirectly, to the side of the film strip, and whereby subsequently, a film packaging bag is formed by means of folding, sealing, and cutting the bag film to shape, in such a manner that the carrier sheet is disposed on the inside of the bag. To make a handle segment of the film strip accessible at the outside of the bag, the bag film is usually provided, before being connected with the carrier sheet, with a punched-out area, weakening line, perforation, or with incisions in the region of the carrying handle, or a combination of these features. In order to make a particularly great carrying load possible, the strip ends may preferably also be connected with one another or with the carrier sheet, or both.

It is practical if a closure sheet is applied to the carrier sheet, in order to tightly close the film bag. The closure sheet or closure sheet segments that cover at least the ends of the carrier sheet, in each instance, in the longitudinal direction, can be applied, without restriction, before or after the carrier sheet is connected with the bag film. Preferably, in this connection, a closure sheet that completely covers the film strip and the carrier sheet is sealed first onto the carrier sheet and then, with the carrier sheet, onto the bag film. After folding, sealing, and cutting of the bag film, the closure sheet is disposed on the inside of the bag.

Preferably, two material webs are brought in to make available the film strip and the carrier strip, and laid on top of one another, whereby subsequently, individual carrier sheets with the related film strips are cut from the material webs. Particularly preferably, the two material webs run parallel, whereby the carrier sheets and film strips cut from the material web have the same length and whereby the strip ends are folded over together with end segments of the carrier sheet. To the extent that, before folding over takes place, the strip ends are connected with the end segments of the carrier sheet, this connection can take place, preferably via heat-sealing, for example, on individual film strips and carrier sheets, or previously, on the material webs that are brought in.

To increase the carrying capacity of the film strip, the material web from which the film strips are cut, or a film sheet from which an individual film strip is formed, can be structured in at least two layers. These layers are connected via sealing seams, which run along the lengthwise edges of the film strip.

The film segment of the bag film that covers the handle segment may not be punched out, but rather may be delimited by a weakening line, perforation, incisions, or a combination thereof. In this case, this segment can be connected with the handle segment by gluing or via heat-sealing, in a preferred embodiment of the method according to the invention.

To allow easy and precise folding during the formation of the film packaging bag, and to allow good machine handling of the pre-finished film packaging bag after folding, a pre-weakening is made on various folded edges before the bag film is folded, in a preferred embodiment of the method according to the invention. The pre-weakening can take place mechanically, thermally, or both. For example, the pre-weakening can be performed with an embossing tool or by laser.

BRIEF DESCRIPTION OF THE DRAWINGS

Other objects and features of the present invention will become apparent from the following detailed description considered in connection with the accompanying drawings. It should be understood, however, that the drawings are designed for the purpose of illustrating only and not as a definition of the limits of the invention.

In the drawings, wherein similar reference characters denote similar elements throughout several views.

DETAILED DESCRIPTION OF PREFERRED EMBODIMENTS

Figure 1:
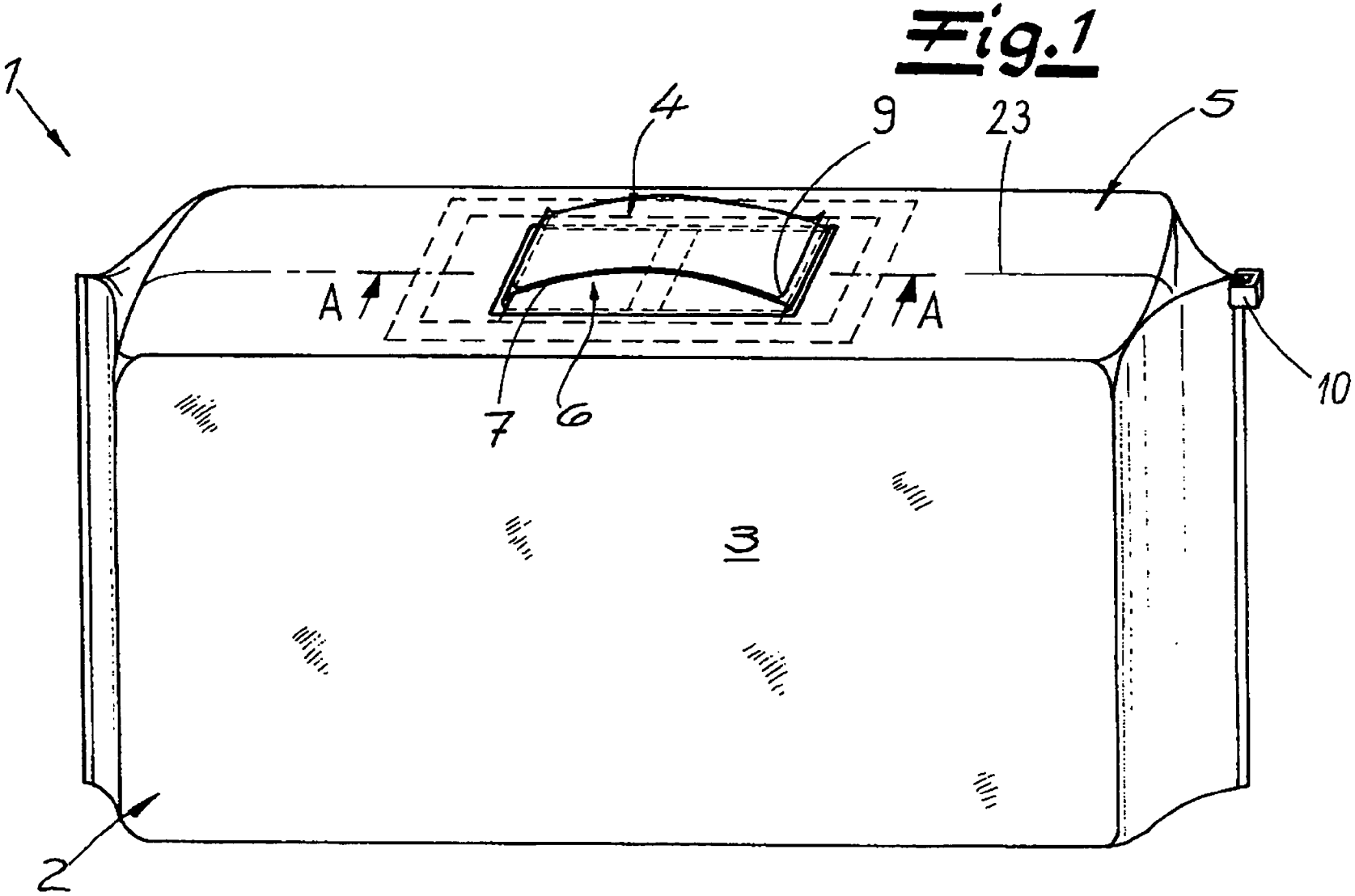
FIG. 1 is a perspective view of a film packaging bag according to the invention, whereby a handle segment of a film strip is released by opening a perforation.

Referring now in detail to the drawings, FIG. 1 shows a film packaging bag 1 having bag surfaces formed by a bag film 2. Film packaging bag 1 is structured as a side fold bag having two front surfaces 3, whereby a carrying handle 4 is disposed approximately in the center of a side fold 5 that connects front surfaces 3 at their edges. Carrying handle 4 has a film strip 6 with a handle segment 7, whereby handle segment 7 is released by opening a weakening line or perforation 8. A film segment 9 of bag film 2 delimited by the weakening line or perforation 8 is connected with handle segment 7, preferably by heat-sealing or gluing. A re-closure 10 is disposed on film packaging bag 1, on one side, between front surfaces 3.

Figure 2:
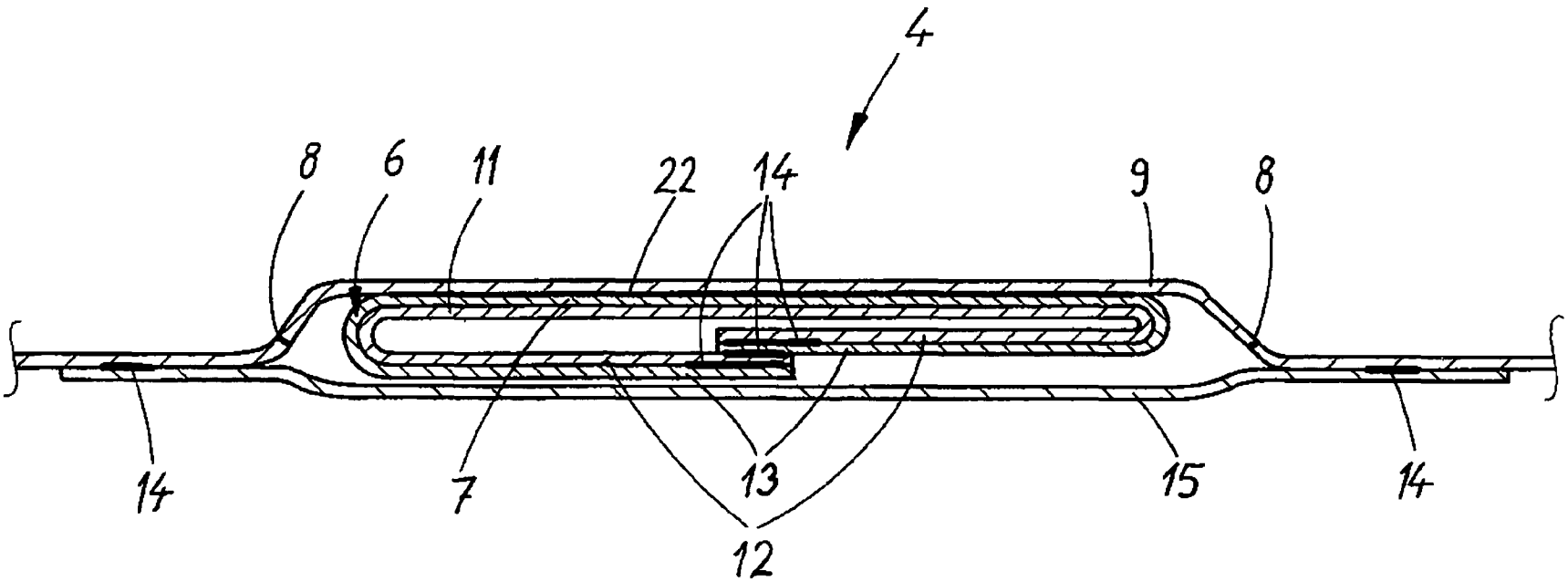
FIG. 2 is a sectional representation along the line A-A of FIG. 1, with an unopened perforation.

FIG. 2 shows a sectional representation along the line A-A of FIG. 1, whereby, however, the perforation 8 or weakening line has not yet been opened, and thus handle segment 7 is still hidden within film packaging bag 1. Film strip 6 is disposed on a carrier sheet 11, whereby the end segments 12 of carrier sheet 11 are folded with strip ends 13 of film strip 6, towards the inside of the bag, so that film strip 6 surrounds carrier sheet 11 with its strip ends 13 that follow on both sides of handle segment 7. Strip ends 13 overlap, in segments, and are connected with end segments 12 of carrier sheet 11, on the one hand, and with one another, on the other hand, by way of a layer of carrier sheet 11, via sealing seams 14. In this connection, film strip 6 forms a closed loop, thereby achieving a very great carrying load of carrying handle 4. Carrier sheet 11 and film strip 6 are completely covered, on the inside of the bag, by a closure sheet 15. When film packaging bag 1 is carried by carrying handle 4, the weight force of film packaging bag 1 is distributed from film strip 6 to carrier sheet 11, whereby carrier sheet 11 is connected with the inside of the bag, directly or by way of closure sheet 15, to the side of film strip 6. In this connection, the carrying force is distributed along sealing seams 14 that run in the longitudinal direction, so that carrying handle 4 is prevented from being torn out even in the case of great carrying loads.

Figure 3:
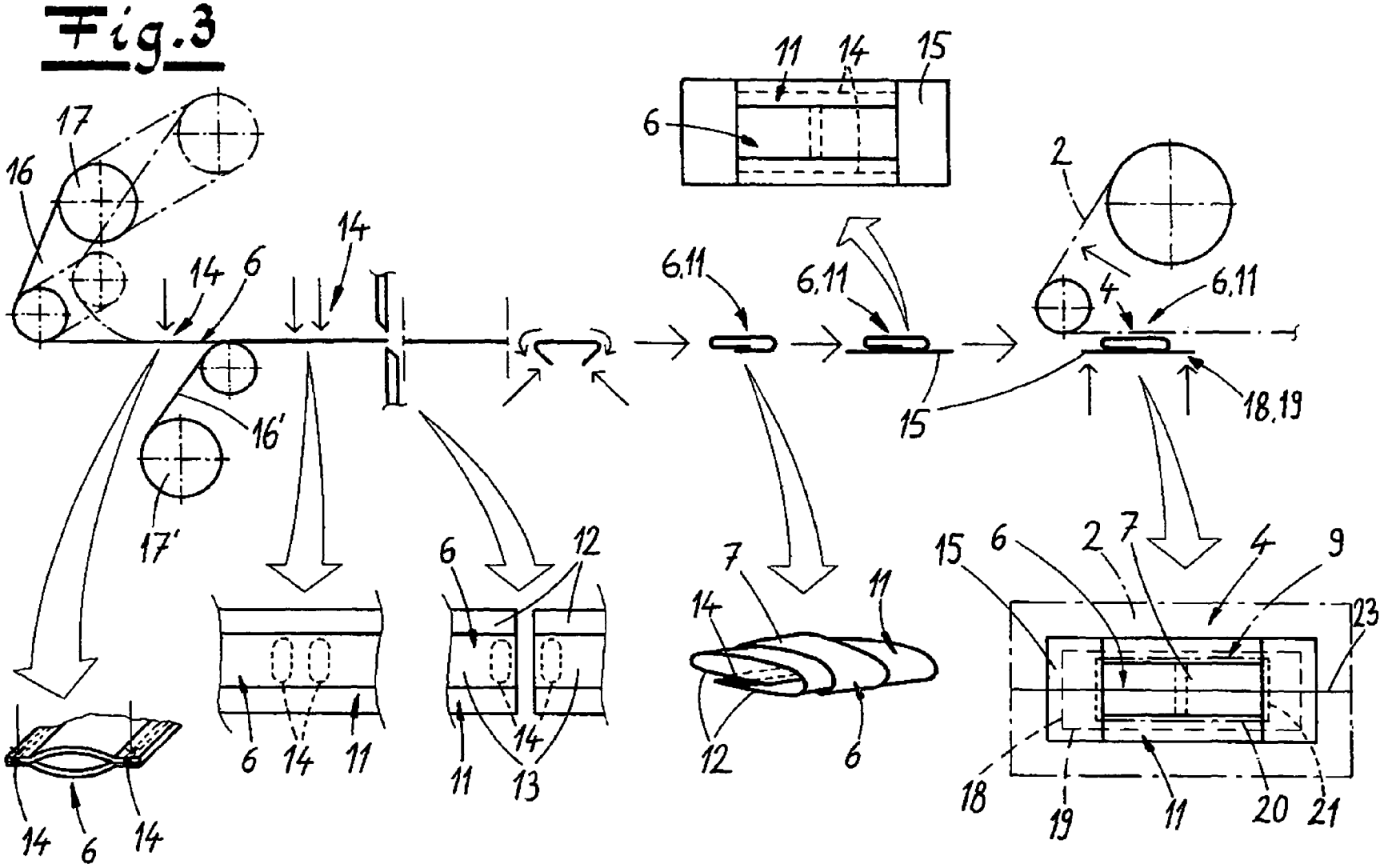
FIG. 3 shows a method for the production of the film packaging bag.

FIG. 3 shows a method for the production of film packaging bag 1, whereby a first material web 16 is brought in from a roll 17, as an endless web, and folded into two layers, to make film strips 6 available. First material web 16, folded into two layers, is provided with sealing seams 14 at its lengthwise edges, and laid onto a second material web 16', which is brought in from a roll 17', as an endless web. First material web 16 and second material web 16' are connected via heat-sealing seams 14, in segments, whereby subsequently, individual carrier sheets 11 having one film strip 6 are cut off, in each instance. In this connection, cutting takes place so that the sealing seams 14 with which a carrier sheet 11 is connected with a film strip 6 are disposed at strip ends 13 and end segments 12 of carrier sheet 11. Subsequently, end segments 12 of carrier sheet 11 and strip ends 13 of film strip 6 are folded onto a center segment of carrier sheet 11, whereby strip ends 13 overlap, in segments, and are sealed to one another at the overlap site. Subsequently, film strip 6 and carrier sheet 11 are laid onto a closure sheet 15, whereby carrier sheet 11 is sealed onto closure sheet 15.

Carrier sheet 11 and closure sheet 15 are subsequently connected with a bag film 2 with crosswise sealing seams 18 and lengthwise sealing seams 19, which run to the side of film strip 6. Bag film 2 was previously provided with incisions 20 that run in the longitudinal direction in the region of handle segment 7 of film strip 6, and with perforation lines 21 that connect incisions 20, whereby when closure sheet 15 and carrier sheet 11 are sealed on, the film segment 9 of bag film 2, which is delimited by perforation lines 21 and incisions 20, is also connected with handle segment 7 with an adhesive 22.

Subsequently, a film packaging bag 1 is formed by folding, sealing, and cutting bag film 2 to size, in such a manner that carrier sheet 11 and closure sheet 15 are disposed on the inside of the bag. In order to allow easy and precise folding of bag film 2, a pre-weakening is preferably made at various folding edges 23 before bag film 2 is folded to form film packaging bag 1.

Although only a few embodiments of the present invention have been shown and described, it is to be understood that many changes and modifications may be made thereunto without departing from the spirit and scope of the invention as defined in the appended claims.

What is claimed is:

1. A film packaging bag comprising:

(a) a bag film comprising a plurality of bag surfaces, an opening, and an inside bag portion;

(b) a carrier sheet; and (c) a carrying handle disposed on one of said bag surfaces comprising a film strip disposed on and surrounding said carrier sheet, said film strip being narrower than said carrier sheet and comprising a handle segment accessible via said opening during use and folded first and second strip ends on each side of the handle segment;

wherein the carrier sheet comprises an intermediate segment and folded first and second end segments, the handle segment lying on said intermediate segment and the strip ends lying on said end segments;

wherein said strip ends overlap, in segments, and are connected with one another, so that the film strip forms a loop;

wherein said film strip is attached to said bag film via said carrier sheet and said carrier sheet is connected directly or indirectly with said inside bag portion laterally to said film strip.

2. The film packaging bag according to claim 1, wherein the strip ends are connected with the carrier sheet.

3. The film packaging bag according to claim 1, wherein the film strip, and the carrier sheet are covered at least in certain segments by a closure sheet on the inside bag portion.

4. The film packaging bag according to claim 1, wherein the bag film has a punched-out area or incisions near the carrying handle for access to the handle segment.

5. The film packaging bag according to claim 4, further comprising a weakening line or a perforation for releasing the handle segment when the weakening line or perforation is opened.

6. The film packaging bag according to claim 5, wherein the bag film has a segment delimited by the weakening line, the perforation, or the incisions and connected via sealing seams or an adhesive with the handle segment.

7. The film packaging bag according to claim 1, wherein the film strip is formed from at least two layers that are connected at lengthwise edges of the film strip via sealing seams.

8. The film packaging bag according to claim 1, further comprising a re-closure.

9. The film packaging bag according to claim 1, wherein the film packaging bag is structured as a side fold bag, wherein the carrying handle is disposed on a side fold.

10. A method for producing a film packaging bag according to claim 1, said method comprising the steps of:

(a) disposing a film strip on a carrier sheet wider than the film strip;

(b) folding strip ends of the film strip over so that the film strip surrounds the carrier sheet with the strip ends;

(c) subsequently directly or indirectly connecting the carrier sheet with a bag film laterally to the film strip; and (d) subsequently folding, sealing, and cutting the bag film to size to form a film packaging bag according to claim 1 wherein the carrier sheet is disposed inside the film packaging bag.

11. The method according to claim 10, wherein the strip ends are connected with one another.

12. The method according to claim 10, wherein the strip ends are connected with the carrier sheet.

13. The method according to claim 10, wherein the strip ends are folded over together with end segments of the carrier sheet.

14. The method according to claim 10, wherein the film strip comprises a handle segment and the bag film has a punched-out area, a weakening line, a perforation or incisions near the handle segment of the film strip before the bag film is connected with the carrier sheet.

15. The method according to claim 10, wherein the film strip and the carrier sheet are cut off from material webs.

16. The method according to claim 10, further comprising making a pre-weakening on a plurality of folded edges of the bag film before the bag film is folded to form the film packaging bag.

* * * * *